US007398572B2

(12) United States Patent
Braun

(10) Patent No.: US 7,398,572 B2
(45) Date of Patent: Jul. 15, 2008

(54) PILLOW WITH NOTEPAD SYSTEM

(75) Inventor: Kyrsten Ann Braun, St. Paul, MN (US)

(73) Assignee: Kyrsten A Braun, St. Paul, MN (US)

( * ) Notice: Subject to any disclaimer, the term of this patent is extended or adjusted under 35 U.S.C. 154(b) by 0 days.

(21) Appl. No.: 11/505,653

(22) Filed: Aug. 17, 2006

(65) Prior Publication Data

US 2007/0089241 A1 Apr. 26, 2007

Related U.S. Application Data

(60) Provisional application No. 60/708,854, filed on Aug. 17, 2005.

(51) Int. Cl.
*A47G 9/00* (2006.01)

(52) U.S. Cl. ..... 5/639; 362/99; 108/23; 108/43; 190/11

(58) Field of Classification Search ..... 5/639, 5/636, 905, 640; 190/11, 10, 1; 362/99; 108/23, 25, 43; 206/224, 573, 575, 576; 150/106

See application file for complete search history.

(56) References Cited

U.S. PATENT DOCUMENTS

| | | | | |
|---|---|---|---|---|
| 2,293,530 | A * | 8/1942 | Beehler | 190/102 |
| 2,806,715 | A * | 9/1957 | Smith | 281/44 |
| 3,863,283 | A * | 2/1975 | Mohr | 5/639 |
| 4,470,620 | A * | 9/1984 | Gerch | 281/31 |
| 4,483,427 | A * | 11/1984 | Gerch | 190/11 |
| 6,851,822 | B2 * | 2/2005 | Herrera | 362/99 |

* cited by examiner

*Primary Examiner*—Alexander Grosz

(57) ABSTRACT

A decorative pillow desktop system comprises a soft cushion top, which reveals, when opened, a notepad, light and pen.

5 Claims, 1 Drawing Sheet

PILLOW WITH NOTEPAD SYSTEM

CROSS-REFERENCE TO RELATED APPLICATIONS

This application claims the benefit of provisional patent application Ser. No. 60/708,854, filed 2005 Aug. 17 by the present inventor.

REFERENCES CITED—U.S. PATENT DOCUMENTS

| | | | |
|---|---|---|---|
| 1,928,806 | 10/1933 | Barcalo | 248/441 |
| 6,434,769 | 8/2002 | Koenig | 5/636 |
| 6,763,537 | 7/2004 | Crear | 5/636 |
| 5,522,507 | 6/1996 | Cruz | 206/575 |
| 5,918,332 | 7/1999 | Dees | 5/639 |
| 6,216,297 | 4/2001 | Lemke | 5/636 |
| 5,447,215 | 9/1995 | Volkmar | 190/11 |
| 6,076,211 | 6/2000 | Chatman | 5/653 |
| 3,263,246 | 8/1966 | Towery | 5/639 |
| 4,826,208 | 5/1989 | Ozmar | 280/751 |
| US 2005/0039261 | 2/2005 | Corral | |

FEDERALLY SPONSORED RESEARCH

Not Applicable

SEQUENCE LISTING OR PROGRAM

Not Applicable

BACKGROUND OF THE INVENTION

1. Field of Invention

This invention relates to note-writing devices, specifically to such devices that are used while in bed or other places of rest.

2. Prior Art

A variety of tools exist for consumers to write down notes while in bed or other places of rest, including:

a) a nightstand with a light, notepad and pen;
b) journal and pen;
c) a diary and pen;
d) an audio recorder;
e) a laptop computer or similar electronic device.

A variety of disadvantages exist with each of these options, including:

a) if a consumer shares his or her bedroom with another person(s) and turns on a lamp or gets out of bed to write down a note, it could be disruptive to the other individual (s) in the room;
b) if a consumer does not have some type of lighting device to use in the dark, it could be difficult to effectively write in a journal, diary or notepad;
c) if a consumer does not have the above-referenced tools in a convenient location next to or in his or her bed, he or she may not be able to write down a note, which could result in a forgotten idea, thought, reminder or dream;
d) If a consumer uses an audio recorder in bed, it could be disruptive to any other individual(s) who shares the consumer's bedroom;
e) If a consumer uses a computer in bed, it could be disruptive to any other individual(s) who shares the consumer's bedroom.

3. Objects and Advantages

Accordingly, besides the objects and advantages of the Pillow With Notepad System described in my above patent, several objects and advantages of the present invention are:

a) to provide a functional, decorative pillow;
b) to remain in the consumer's bed or other place of rest at all times to ensure the tools necessary to capture a note are always available;
c) to offer an effective source of light so consumer's can effectively write a note in the dark;
d) to minimize disruption to any other individual(s) who shares the consumer's bedroom, with the pillow's compact size, quiet clasp and minimal light.

SUMMARY

In accordance with the present invention, a decorative pillow desktop system comprises a functioning soft cushion top, which reveals when open a notepad, light and pen, intended for use in bed or in other places of rest to capture ideas, thoughts, reminders and dreams.

DRAWINGS—FIGURES

DRAWINGS—REFERENCE NUMERALS

Figure 1:
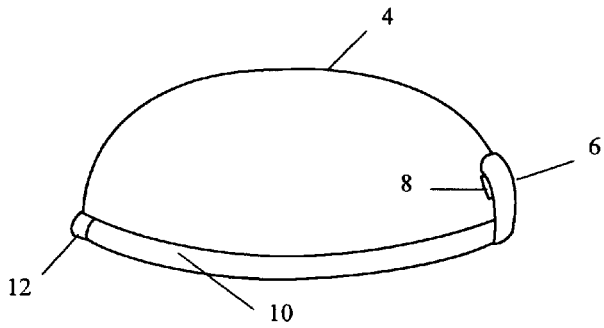
FIG. 1 is a side view of the pillow while closed (in the preferred orientation).
Figure 2:
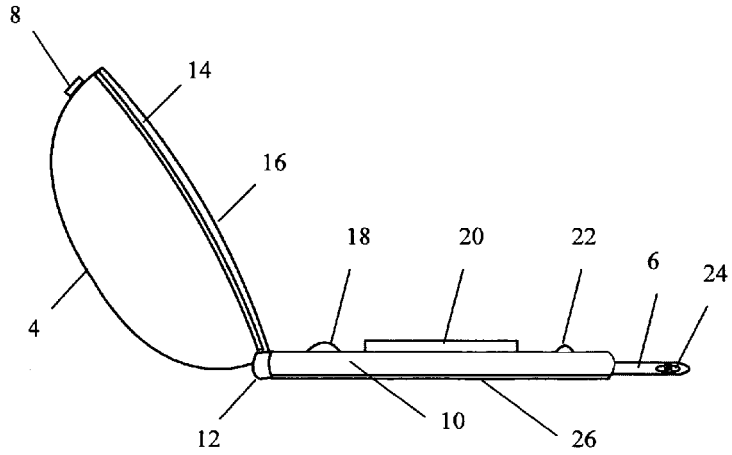
FIG. 2 is a side view of the pillow while open (in the preferred orientation).
Figure 3:
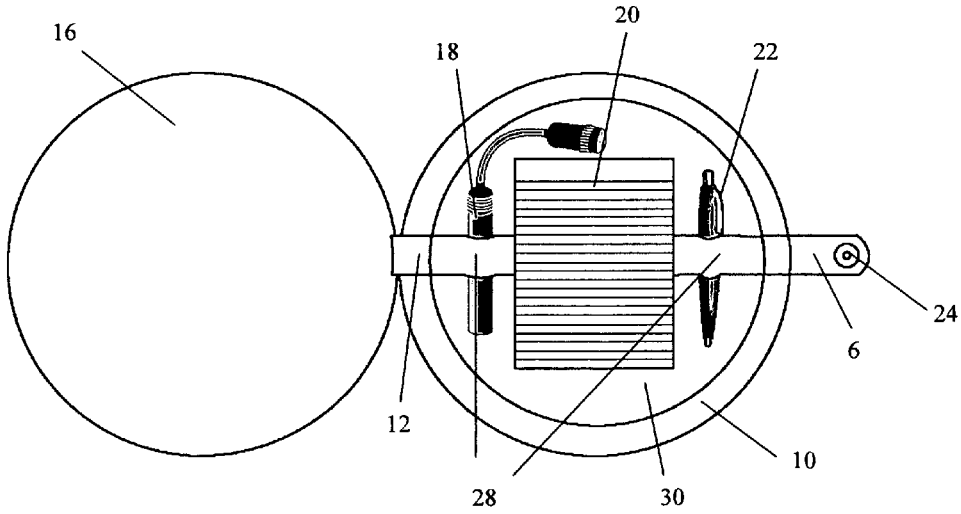
FIG. 3 is an aerial view of the pillow while open (in the preferred orientation).

4—Pillow top, comprised of fabric and soft filling
6—Latch
8—Magnetic snap "female"
10—Hoop
12—Hinge
14—Zipper (encloses soft filling)
16—Pillow base
18—Light
20—Notepad
22—Pen
24—Magnetic snap "male"
26—Bottom
28—Band securing light, notepad and pen
30—Inside bottom

DETAILED DESCRIPTION—FIGS. 1, 2 AND 3—PREFERRED EMBODIMENT

The preferred embodiment selected to illustrate my invention comprises of a pillow top 4, with soft filling sealed with a zipper 14, attached to a pillow base 16. A magnetic snap 8 is secured to the pillow top 4. This combined pillow top 4 with pillow base 16 is connected to a hoop 10 by a hinge 12, which is placed on the opposite end of the magnetic snap 8. The pillow top 4 and combined pillow base 16 are fastened to the bottom 26 with a latch 6, comprised of the same material used on the pillow top 4, and magnetic snap 24, which is aligned to attach to magnetic snap 8 in the pillow top 4. The same fabric or material used to cover the pillow top 4 is used to cover the hoop 10. The hoop 10 is attached to the inside bottom 30, which is attached the bottom 26. A band 28 is stitched to the inside bottom 30 to accommodate the insertion of a light 18, notepad 20 and pen 22.

ALTERNATIVE EMBODIMENTS

These are not the only embodiments of my invention. Alternatively:

- Different materials, patterns, sizes, shapes and interconnections can be used for all components.
- Different styles of lights can be added to the piece, such as built-in lights that activate when the pillow is opened, when a switch is triggered or in some other way.
- In lieu of the magnetic snap used to fasten the piece, other styles of closures can be used, such as snaps, zippers, hook-and-loop fasteners, buttons, Velcro®, etc.
- In lieu of a zipper used to enclose the pillow-top filling, other types of closures could be used, such as hook-and-loop fasteners, snaps, buttons, Velcro®, stitching, etc.
- The bottom of the piece could be comprised of a non-slip rubber, vinyl, fabric or other material.
- Additional pockets, bands and other components can be added to the piece to accommodate other items, such as extra notepads, batteries, etc.
- A flag, flap or other indicator can be added to the piece, which can be repositioned to notify the owner that a message was documented.
- The orientation of the piece can vary, with the spine on the left-hand or right-hand side, at the top, at the bottom or in some other position.
- The pillow itself can be modified to include a storage cavity for items, such as chapstick, lotion, medications, flashlights, pens, notepads, etc.
- The items contained in the piece, such as flashlights, notepads and pens, can vary in size, location, type, etc.
- The piece can be modified to include other items, such as books, hand-held computer devices, stationery, journals, etc.

Although the description above contains many specifications, these should not be construed as limiting the scope of the invention but as merely providing illustrations of some of the presently preferred embodiments of this invention. This, the scope of the invention should be determined by the appended claims and their legal equivalents, rather than by the examples given.

I claim:

1. A pillow top and base containing objects for writing a note, comprising:

a) a soft pillow top that is large enough to cover the contents over which it lies, the soft pillow top including a zipper extending around a base perimeter within which a soft filler is contained;

b) a separate bottom with hard surface configured to serve as a writing surface, the bottom further comprising elastic bands holding a light, notepad and pen; and c) a hoop surrounding and coupled to the separate bottom;

d) said soft pillow top being attached to said bottom and to said hoop by a hinge and supported in a closed position by a snap closure on the side opposite said hinge.

2. A pillow notepad system comprising:

a soft pillow top comprising a soft fabric, the pillow top coupled to a pillow base with a zipper, wherein the soft pillow top is filled with a soft filling and contained therein by the zipper thereby forming a pillow;

a magnetic snap fixed to the pillow top;

a hoop;

a separate bottom coupled within the hoop, the separate bottom comprising a hard surface configured as a writing surface, the separate bottom further comprising elastic bands holding a light, notepad and pen;

a hinge attached between the pillow top and the coupled hoop and separate bottom; and a latch coupled to the separate bottom and configured with a snap that engages the magnetic snap on the pillow top in order to hold the pillow top and separate bottom closed together.

3. The pillow notepad system of claim 2, wherein the latch is configured directly across the separate bottom from the hinge such that they are on opposite sides of the bottom.

4. The pillow notepad system of claim 2, wherein the respective perimeters of the pillow top and separate bottom are substantially circular-shaped.

5. The pillow notepad system of claim 2, wherein the hoop comprises the same soft fabric as the pillow top.

* * * * *